United States Patent [19]

Mitchell et al.

[11] 3,957,459

[45] May 18, 1976

[54] COAL GASIFICATION ASH REMOVAL SYSTEM

[75] Inventors: Willard N. Mitchell; Edward L. Wilson; Hermann E. Von Rosenberg, all of Baytown, Tex.

[73] Assignee: Exxon Research and Engineering Company, Linden, N.J.

[22] Filed: Apr. 4, 1974

[21] Appl. No.: 457,958

[52] U.S. Cl. ..... 48/197 R; 48/202; 48/206; 48/210; 48/DIG. 4; 201/31; 209/138; 209/154

[51] Int. Cl.[2] ..... C10J 3/54; B07B 4/00

[58] Field of Search ..... 201/31; 48/202, 206, 48/210, 197 R, DIG. 4; 209/138, 139, 154, 434

[56] References Cited

UNITED STATES PATENTS

| | | | |
|---|---|---|---|
| 2,623,815 | 12/1952 | Roethali et al. | 48/DIG. 4 |
| 2,623,817 | 12/1952 | Lewis | 48/206 |
| 2,741,549 | 4/1956 | Russell | 209/138 X |
| 2,959,284 | 11/1960 | Molstedt | 209/138 |
| 3,322,521 | 5/1967 | Cockerham | 48/63 |
| 3,694,346 | 9/1972 | Blaser et al. | 48/206 |
| 3,874,739 | 4/1975 | Mitchell | 48/197 R X |

*Primary Examiner*—S. Leon Bashore
*Assistant Examiner*—Peter F. Kratz
*Attorney, Agent, or Firm*—James E. Reed

[57] ABSTRACT

In a fluidized bed process for the gasification of coal or similar carbonaceous solids wherein char particles are withdrawn from a fluidized bed reaction vessel, transported to a second vessel, and later returned to the initial vessel, char particles of high ash content are separated from particles to be returned to the fluidized bed reaction vessel by injecting a dense phase stream of char particles including particles of both high and low ash content into a vertically moving gas stream having a velocity sufficient to transport relatively light particles of low ash content upwardly into the fluidized bed reaction vessel but insufficient to suspend relatively dense particles of high ash content, collecting the high ash content particles which are not entrained by the gas stream, and periodically withdrawing the collected particles from the system.

10 Claims, 3 Drawing Figures

RAW PRODUCT GAS
COAL FEED
FLUE GAS
CARRIER GAS
COOLANT
STEAM
STEAM
CONTROL GAS
LIFT GAS
FLUSH
ASH
ASH
CONTROL GAS
CONTROLLER
AIR
$O_2$-CONTAINING GAS
FINES RETURN GAS
CONTROL GAS
LIFT GAS
FLUSH

COAL GASIFICATION ASH REMOVAL SYSTEM

BACKGROUND OF THE INVENTION

1. Field of the Invention: This invention relates to the gasification of coal and similar carbonaceous solids and is particularly concerned with a method for the removal of ash during fluidized bed coal gasification and related operations.

2. Description of the Prior Art: A number of different processes for the gasification of coal and similar carbonaceous solids have been developed in recent years. Among the most promising of these are fluidized bed processes in which feed coal particles are devolatilized to produce hydrocarbon gases and char and char is reacted with steam to form synthesis gas. The reactions involved, which may be carried out in a single vessel or in two or more reactors, are highly endothermic and require that large amounts of heat be supplied. This is generally done by burning a portion of the char, either by injecting oxygen into the fluidized bed with the steam or by withdrawing char from the bed, passing it to a separate combustion zone, and then returning hot char particles to the fluidized bed reaction vessel. The gasification and combustion reactions which thus take place result in the production of significant quantities of ash. The ash not carried overhead with the product gases tends to accumulate in the system and must be removed if the process is to operate continuously.

Several different methods for coping with the ash removal problem have been proposed. Much of the early coal gasification work was carried out with slagging type gasifiers which were operated at temperatures above the ash fusion point and therefore resulted in the formation of an ash which could be quenched and withdrawn as slag from the lower part of the gasifier. Such a system is useful for the removal of ash from gasifiers designed for the production of synthesis gases of low methane content but poses problems where high B.t.u. product gases are desired. The high temperatures required to melt the ash tend to crack any methane present and hence the B.t.u. content of the product gas will be low. An alternate procedure is to withdraw a portion of the char from the system continuously. This, of course, has disadvantages in that it results in the discharge of substantial quantities of carbon that could otherwise be employed in the gasification process.

During coal gasification, the density of the char particles increases as carbon is consumed. It has been suggested that this density difference be used to permit the separation of char particles having high ash contents from those which contain greater quantities of carbon and less ash. To accomplish this, it has been proposed that a portion of the steam or other reactant gas to be used in the fluidized bed be injected into the lower portion of the fluidized bed reaction vessel at a relatively low rate which is sufficient to suspend the lighter particles of low ash content but insufficient to suspend the heavier particles. The additional gas required to maintain the bed in the fluidized state is introduced at a somewhat higher rate above the lower gas inlet. Coal particles fed into such a system near the top of the reaction vessel become fluidized and circulate within the bed. Lighter particles of low ash content which find their way into the zone below the level at which the main fluidizing gas is injected are entrained and carried back into the bed. Heavier particles of higher ash content which fall into the zone below the main gas injection level and cannot be entrained tend to accumulate in the lower portion of the vessel and can be withdrawn as a high ash content stream.

A system of the type described above has advantages over earlier methods proposed for the removal of ash but requires very careful control of the gas velocities if effective separation of the particles is to be obtained. Because of the erratic movement of particles within the fluidized bed, many of the heavier particles tend to remain suspended in the upper part of the system and may never reach the lower zone below the main gas inlet. This is particularly true in systems where particles are continuously circulated between the fluidized bed and a separate combustion vessel. As a result, the amount of ash removed from such a system by the above method may tend to be low and the amount of carbon withdrawn with the ash which is removed may tend to be relatively high. This reduces the efficiency of the system, may eventually result in deposit problems despite the removal of a pair of the ash, and may be accompanied by other difficulties. Moreover, the internal equipment which must be provided in the lower part of the fluidized bed gasifier if the above method is to be used may interfere with the return of hot char to the lower end of the gasifier, thus rendering the entire system inoperative. Efforts to avoid these and related problems have in the past been largely unsuccessful.

SUMMARY OF THE INVENTION

This invention provides an improved method for the removal of ash during coal gasification and similar operations requiring the circulation of char particles between a fluidized bed reaction vessel and a second vessel which at least in part overcomes the difficulties outlined above. In accordance with the invention, it has now been found that char particles having high ash contents can be effectively separated from particles to be returned to the fluidized bed reaction vessel during such an operation by introducing a dense phase stream of the solids into a vertically moving gas stream having a velocity sufficient to entrain low ash content particles and transport them upwardly in the fluidized bed reaction vessel but insufficient to suspend high ash content particles, collecting the particles of high ash content which are not entrained by the upwardly moving gas, and thereafter withdrawing the collected particles from the system.

Laboratory and pilot plant tests have shown that this method permits the effective removal of ash from gasifiers and similar vessels containing char particles without the loss of excessive quantities of carbon, that it prevents the buildup and accumulation of ash deposits within such vessels, that it eliminates the necessity for close control of the gas velocity within the fluidized bed vessels themselves, and that it has other advantages over ash removal systems proposed in the past. As a result of these advantages, the method of the invention has many potential applications.

The apparatus employed in practicing the invention will normally comprise an injection device which is connected to a standpipe through which dense phase solids are returned following the withdrawal of particles from the fluidized bed and to a vertical intake line through which char particles are carried upwardly into the fluidized bed reaction vessel. The injection device will preferably include a substantially vertical channel or conduit through which a gas stream can be injected upwardly into the fluidized bed reaction vessel inlet line and a substantially horizontal channel or passageway intersecting the gas conduit for introducing a dense phase stream of solid particles from the standpipe into the gas stream. A tapered flow restriction or nozzle for accelerating the stream of solids prior to its introduction into the upflowing gas may be provided. The cross-sectional area of the inlet side of this flow restriction or nozzle, if such a flow restriction is provided, will generally be between about 1.2 and about 10 times that of the outlet side. Control gas inlets may be located in the wall of the gas conduit opposite the solids passageway and near the upstream end of the apparatus. By regulating the amount of control gas introduced at the various inlets, the rate at which the solid particles are introduced into the gas stream can be controlled. The apparatus can also be used to cut off the flow of solids entirely if desired. Apparatus of this type facilitates the use of the method and normally results in somewhat smoother operation than might otherwise be obtained.

DESCRIPTION OF THE PREFERRED EMBODIMENTS

Figures 1, 2, 3:
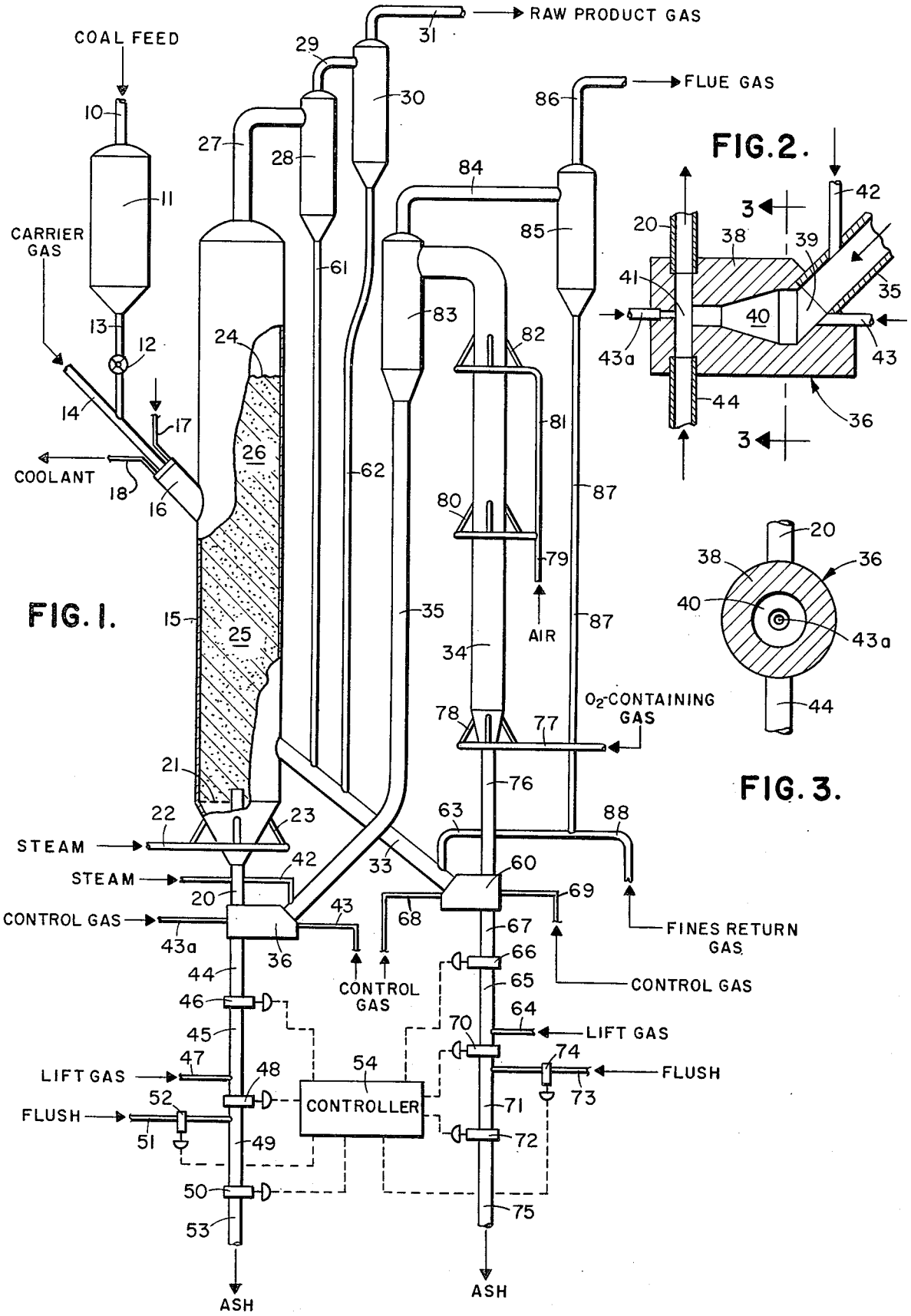
FIG. 1 in the drawing is a schematic diagram showing a coal gasification process in which ash is withdrawn from a gasifier and a combustion vessel in accordance with the invention.
FIG. 2 is an enlarged, sectional view of a gasifier char injection device useful for purposes of the invention.
FIG. 3 is a cross-sectional view of the apparatus of FIG. 2 taken about the line 3—3 in FIG. 2.

The process depicted in FIG. 1 of the drawing is an endothermic process for the production of a product gas stream of relatively high methane content by the treatment of bituminous coal, subbituminous coal, lignite or similar carbonaceous material which will react with steam at high temperatures to form char. The solid feed material employed in the process, preferably a bituminous or lower rank coal, is introduced into the system through line 10 from a preparation plant or similar facility, not shown, in which the coal or other feed material is crushed, dried and screened, or from a storage facility which does not appear in the drawing. To facilitate handling of the solid feed material in a fluidized state, the coal or other carbonaceous solid is introduced to the system in a finely divided condition, normally less than about 8 mesh in size on the Tyler Screen Scale.

The process carried out in the system shown in FIG. 1 is operated at elevated pressures and hence the coal or other feed material introduced through line 10 is fed into vessel 11, from which it is discharged through star wheel feeder or similar device 12 in line 13 at the system operating pressure or at a slightly higher pressure. In lieu of or in addition to this particular type of arrangement, parallel lock hoppers, pressurized hoppers, aerated standpipes operated in series, or other apparatus may be employed to raise the input coal stream to the required pressure level. The use of such equipment for handling coal and other finely-divided solids at elevated pressures has been described in the literature and will therefore be familiar to those skilled in the art. Equipment which may be employed for this purpose is generally available from commercial sources.

A carrier gas stream is introduced into the system of FIG. 1 through line 14 to permit the entrainment of coal particles or other solid feed material from line 13 and facilitate introduction of the solids into gasifier 15. High pressure steam or product gas may be employed as the feed gas stream. The use of recycled product gas avoids reduction of the hydrogen concentration in the gasifier and is therefore normally preferred. The carrier gas stream is introduced into the system at a pressure between about 50 and about 1500 psig, depending upon the pressure at which gasifier 15 is operated and the solid feed material employed. A pressure between about 100 and about 500 psig is preferred. The gas is normally introduced at a temperature in excess of about 300° F. but below the initial softening point of the coal or other carbonaceous feed material. For the gasification of bituminous coals, the use of carrier gas input temperatures in the range of from about 400° to about 550° F. is generally preferable. The coal particles introduced through line 13, preferably less than about 20 mesh in size on the Tyler Screen Scale, are suspended in the input carrier gas fed through line 14 in a ratio between about 0.2 and about 2.0 pounds of coal per pound of carrier gas. The optimum ratio for a particular system will depend in part upon the coal particle size and density, the molecular weight of the gas employed, the temperature of the coal and input gas stream, and other factors. In general, ratios between about 0.5 and about 1.5 pounds of coal per pound of carrier gas are preferred. The resultant stream of carrier gas and entrained coal or similar feed particles is then fed through a fluid-cooled nozzle 16 into the gasifier. The cooling fluid, which will normally be low pressure steam but may also be water or other fluid, may be introduced into the nozzle through line 17 and recovered by means of line 18. Alternatively, the cooling gas or other fluid may in some cases be injected into the gasifier around the injected stream of solids to control its entry into the fluidized bed contained in gasifier 15.

The gasifier employed in the system comprises a refractory-lined vessel containing a fluidized bed of char particles introduced into the lower part of the vessel through inlet line 20. The inlet line extends upwardly through the bottom of the gasifier to a point above grid or similar distribution device 21. Steam for maintaining the char particles in a fluidized state and reacting with the char to produce a synthesis gas containing substantial quantities of hydrogen and carbon monoxide is introduced into the gasifier below the grid through manifold 22 and injection nozzles 23. The installation shown utilizes four steam nozzles spaced at 90° intervals about the periphery of the gasifier but a greater or lesser number may be employed if desired. The steam introduced through the nozzles will normally be fed into the system at a rate within the range between about 0.5 and about 2.0 pounds per pound of coal feed. The upflowing steam and suspended char particles form a fluidized bed which extends upwardly in the gasifier to a level above the point at which the coal particles are introduced by means of nozzle 16. The upper surface of this fluidized bed is indicated in the drawing by reference numeral 24.

The lower portion of the fluidized bed in gasifier 15 between grid 21 and the level at which the coal particles are fed into the gasifier through nozzle 16, indicated generally by reference numeral 25, serves as a steam gasification reaction zone. Here the steam introduced through the manifold and steam injection nozzles reacts with carbon in the hot char particles to form synthesis gas in accordance with the reaction: $H_2O + C \rightarrow H_2 + CO$. At the point of steam injection near the lower end of the gasifier, the hydrogen concentration in the gaseous phase of the fluidized bed will normally be essentially zero. As the steam moved upwardly through the fluidized char particles, it reacts with the hot carbon to produce synthesis gas and the hydrogen concentration in the gaseous phase thus increases. The temperature in the steam gasification zone will generally range between about 1450° and about 1950° F. Depending upon the particular feed material and particle sizes employed, the gas velocities in the fluidized bed will generally range between about 0.2 and about 2.0 feet per second.

The upper portion of the fluidized bed in reaction vessel 15, indicated generally by reference numeral 26, serves as a hydrogasification zone where the feed coal is devolatilized and at least part of the volatile matter thus liberated reacts with hydrogen generated in the steam gasification zone below to produce methane as one of the principal constituents of the product gas. The point at which the coal feed stream is introduced into the gasifier through nozzle 16 and hence the location of the steam gasification and hydrogasification zones depends in part upon the properties of the particular coal or carbonaceous solid which is employed as the feed material for the process. It is generally preferred to select the nozzle location so that the methane yield from the gasifier will be maximized and the tar yield minimized. In general, the amount of methane produced increases as the coal feed injection point is moved toward the top of the fluidized bed. The tar formed from the input coal, which has a tendency to foul downstream processing equipment, normally increases in amount as the coal injection point is moved upwardly and decreases as the coal injection point is moved toward the bottom of the fluidized bed, other operating conditions being the same. The coal feed stream should generally be introduced into the gasifier at a point where the hydrogen concentration in the gas phase is in excess of about 20% by volume, preferably between about 30 and about 50% by volume. To secure acceptable methane concentrations in the product gas stream, the upper surface 24 of the fluidized bed should normally be located at a level sufficiently above the nozzle 16 to provide at least about 4 seconds of residence time for the gas phase in contact with the fluidized solids in the hydrogasification zone. A residence time for the gas in contact with the solid phase above the coal injection point of between about 10 and about 20 seconds is normally preferred. It will be understood, of course, that the optimum hydrogen concentration at the coal injection point and the gas residence time above that point will vary with different types and grades of feed coal and will also change with variations in the gasifier temperature, pressure, steam rate and other process variables. Higher rank coals normally require somewhat more severe reaction conditions and longer residence times to obtain high methane yields than do coals of lower rank. Similarly, high reaction temperatures and steam rates generally tend to increase the hydrogen concentration in the gas phase and thus reduce the solids residence time needed to secure acceptable methane yields from a particular feed coal.

Gases from the fluidized bed move upwardly from the upper surface 24 of the bed, carrying entrained fines with them. These gases are withdrawn from gasifier 15 through overhead line 27 and pass to cyclone separator or similar separation device 28 where the larger particles are separated from the gas. The gas taken overhead from separation unit 28 through line 29 will normally contain entrained fines too small to be taken out by the separation unit. This gas may therefore be passed to a second centrifugal separator or similar unit 30 for the removal of additional fine particles. The raw product gas is withdrawn overhead from this second separation unit through line 31 and may be passed to conventional downstream facilities for cooling, for the removal of water and any additional entrained solids, for treatment to take out carbon dioxide and sulfur compounds, and the like. If desired, the treated gas can then be passed through a catalytic shift conversion unit to adjust the hydrogen-to-carbon monoxide ratio and then introduced into a methanation unit to increase the amount of methane and raise the B.t.u. content of the gas. All of these downstream gas treating and processing steps may be carried out in a conventional manner and will therefore be familiar to those skilled in the art.

The heat required to sustain the endothermic reaction taking place in the gasifier is provided by continuously withdrawing char particles from the lower part of the fluidized bed by means of line 33, passing these particles through a transfer line burner or similar combustion zone 34, and returning hot particles through line 35 to gasifier injection device 36. The gasifier injection device is shown in greater detail in FIGS. 2 and 3 of the drawing. This device comprises a housing 38 containing an entrance section 39, an intermediate section 40, and a separation section 41. The entrance section extends downwardly at an angle of from about 30° to about 75° from the horizontal, preferably about 60°, and forms a continuation of line 35. Vertical line 42 extends downwardly into the upper part of line 35 at the mouth of the entrance section for the introduction of steam, recycle product or flue gas, nitrogen or other control gas into the entrance section. Horizontal line 43 extends through the wall of the entrance section on or near the center line of the intermediate section 40 to permit the admission of additional control gas. The diameters of these two lines should be sufficient to permit the injection of control gas in the desired quantities at a pressure in excess of that within the gasifier. The intermediate section of the device may include a conical flow restriction or nozzle having an upstream cross-sectional area of from about 1.2 to about 10 times the downstream cross-sectional area. The walls of this flow restriction, if such a restriction is used, will normally converge inwardly from the inlet to the outlet at an angle of from about 15° to about 45° to the horizontal, preferably about 30°. The particular dimensions selected will depend primarily upon the velocity and volume of the incoming dense phase stream of char particles and the extent, if any, to which the particles are to be accelerated within section 40. Inlet-to-outlet cross-sectional area ratios in section 40 of between about 3.1 and about 7.1 are normally preferred. Alternatively, the intermediate section may be of substantially uniform diameter over its entire length. The separation section 41 comprises a generally horizontal passageway which extends from the outlet of the intermediate section and intersects a generally vertical passageway extending between a lift gas inlet line 44 at the bottom of the injection device and gasifier inlet line 20 at the top of the injection device. Horizontal control gas inlet line 43*a* extends into the wall of the separation section on or near the center line of the intermediate section and thus substantially opposes horizontal control gas inlet line 43. Line 43*a* is not always essential and in some cases may be omitted. It will be understood, of course, that the apparatus employed for purposes of the invention is not restricted to the precise structure depicted in FIGS. 2 and 3 and that various modifications may be made without departing from the invention.

The downflowing dense phase stream of solids to be returned to the gasifier through line 20 flows into the entrance section 39 of gasifier injection device 36 from line 35. This stream will typically have a velocity in the range from about 0.05 to about 0.3 foot per second as it enters the injection device. The velocity may vary considerably, of course, depending upon the density of the char particles being circulated, the dimensions of the particles, and the amount of gas present in the flow stream. Control gas is introduced through vertical and horizontal inlet lines 42 and 43 to promote smooth flow of the particles into the injection device and counteract the reduction of velocity which may otherwise tend to take place as the stream changes direction and moves into the intermediate section 40. By varying the amount of control gas injected through lines 42 and 43, the flow into the injection device can be shut off completely or increased from the initial level to about 0.2 foot per second or higher, again depending upon the characteristics of the particles and other factors. In an injection device including a converging nozzle in the intermediate section, the particle stream may be accelerated from a velocity of from about 0.2 foot per second or somewhat higher to a final velocity between about 0.5 foot per second and about 1.5 feet per second or more, depending in part upon the ratio between the inlet cross-sectional area and the outlet cross-sectional area. As indicated earlier, this ratio may range between about 1.2:1 and about 10:1 and will preferably be between about 3:1 and about 7:1. The passage of the solids through the converging nozzle accelerates the particles and tends to isolate the downstream fluid system from pressure surges which may otherwise tend to produce slug flow and interfere with handling of the solids. As indicated earlier, however, this is not essential and in some cases the intermediate section may be of substantially uniform diameter.

The particles emerging from intermediate section 40 move in a substantially horizontal direction into the separation section 41. Here the particles enter the upflowing stream of lift gas introduced through line 44. On reaching the gas stream, the particles lose their horizontal component of velocity and, depending upon their density, are either entrained by the upflowing gas or fall downwardly through the rising gas stream. The lift gas velocity at this point is controlled so that the velocity is sufficient to entrain particles having an ash content less than about 65 weight percent but insufficient to entrain particles having an ash content greater than about 85 weight percent. The heavier, high ash content particles, preferably those containing more than 85 weight percent ash, are not suspended and instead settle downwardly through the gas. The lighter char particles, preferably those containing less than 65 weight percent ash, are entrained by the gas and carried upwardly as a dense phase stream through line 20 into the fluidized bed in the gasifier above grid 21. Here the solids are further accelerated by steam introduced through line 22 and steam injection nozzles 23 to permit maintenance of the bed in the fluidized state. The amount of steam injected through the nozzles can be regulated as necessary to obtain optimum fluidized bed reaction conditions. The lift gas employed to convey the low ash content particles upwardly into the bed, normally steam, recycle product gas, flue gas or the like, has little effect upon the amount of steam used.

The lift gas velocity required in line 44 will depend in part upon the sizes and densities of the particles injected into the upflowing stream of gas but will generally be between about 0.05 and about 3.0 feet per second. Velocities between about 0.1 and about 2.0 feet per second are normally adequate and are preferred. The velocity required in a particular operation can readily be determined by monitoring the ash content of the particles withdrawn from the system and increasing or reducing the gas velocity until the desired ash content is obtained. A pronounced advantage of the system is that it permits changes in the lift gas velocity without seriously affecting the fluidized bed in the gasifier itself.

The heavier, high ash content particles moving downwardly countercurrent to the lift gas in inlet line 44 settle into ash trap 45 below valve 46. Here an elutriation process takes place, any lighter particles carried downwardly with the heavier materials being displaced by heavier particles and carried upwardly by the rising gas which is introduced into the trap through line 47 above valve 48. Valve 46 normally remains open and serves as an emergency valve for isolating the ash trap if necessary. Valve 48 is normally closed so that the system can be maintained under the required pressure. Ash container 49 provided with valve 50 at its lower end is located below valve 48. Valve 50 is normally closed. Periodically, valve 48 is opened to permit the solids accumulated in trap 45 to settle downwardly into container 49. After this has been done, valve 48 is again closed and valve 50 is opened. Water or a similar flushing fluid may be introduced through line 51 and valve 52 to cool the accumulated solids and flush them from the system. The cooled ash is thus discharged through line 53. Thereafter, influx of the flushing liquid is terminated by means of valve 52 and valve 50 is again closed. The valves employed in the ash disposal system may be manually operated if desired but will preferably be electrically or hydraulically controlled valves operated in regular sequence by means of a controller 54 as shown. Suitable controllers or other timing devices capable of actuating a series of electrically or hydraulically controlled valves in a predetermined sequence are available commercially and will be familiar to those skilled in the art. The ash-containing particles recovered can be used as an auxiliary fuel or otherwise employed.

The char particles which are withdrawn from the fluidized bed in gasifier 15, circulated through the transfer line burner and returned to the gasifier following the removal of ash as described above are conveyed downwardly in dense phase flow through line 33 to burner injection device 60. Solids removed from the product gas in cyclone separators 28 and 30 are conveyed downwardly through stand pipes 61 and 62 and added to the solids stream in line 33 before it reaches the injection device. Alternatively, these fines may be reintroduced into the gasifier. SImilarly, fines recovered from the flue gas and entrained in a suitable carrier gas as described hereafter may be introduced into line 33 upstream of the inlet device by means of line 63. The dense phase solids stream which thus enters the burner injection device 60 is separated into a high ash content stream and a stream of lower ash content by means of lift gas which is introduced into the system through line 64 and passes upwardly through ash trap 65, valve 66 and lift gas inlet line 67. The lift gas used will normally be recycled flue gas but may be steam or other substantially inert gaseous fluid. Control gas is introduced into the injection device through lines 68 and 69 to obtain smooth flow of the solids and regulate the amount of separation which takes place. The heavy solid particles of high ash content which fall downwardly into ash trap 65 accumulate in the ash trap, any lighter particles being replaced by heavier particles through elutriation. The accumulated ash-containing particles are periodically removed from the system by opening valve 70 below the ash trap so that the particles can fall downwardly into ash container 71. This in turn is emptied periodically by closing valve 70, opening lower valve 72, and flushing out the container with water or other fluid admitted through line 73 and valve 74. The cool ash-containing constituents are recovered through line 75. Again, the valves employed in the burner ash removal system may be manually operated but will normally be electrically or hydraulically actuated valves controlled by controller or timer 54 so that they operate at the required frequency and in the necessary sequence. Although the system thus described includes provisions for the removal and collection of ash at each of two separate points in the system, it should be noted that this is not always essential and that in some cases the ash content may be maintained at suitably low levels by removing high ash particles from either the solids introduced into the burner or from the solids returned to the gasifier.

The low ash content solids entrained by the lift gas and injection device 60 are carried upwardly in dense phase flow through burner inlet line 76 into the lower portion of the transfer line burner. An oxygen-containing gas, preferably air or a mixture of air and flue gas, is introduced through line 77 and multiple injection nozzles 78 in a quantity sufficient to promote a rapid transition from dense phase flow to dilute phase flow. The amount of gas used and the gas composition employed will depend in part upon the chemical and physical characteristics of the char particles, the amount and composition of the lift gas moving upwardly from the inlet device, the particle acceleration required to achieve dilute phase flow, the distribution of the injection nozzles about the burner, the dimensions of the system, the combustion efficiency, the heat losses which occur, and other factors. The use of a plurality of nozzles spaced at regular intervals about the burner periphery as shown promotes more uniform contact between the injected gas and the upflowing solids and thus improves combustion efficiency and aids in avoiding localized overheating.

Additional oxygen-containing gas is injected into the burner through line 79 and peripherally spaced nozzles 80 at a second point above the first injection point. Here the particles are further accelerated. If the gas injected at the lowermost nozzles contains significant quantities of oxygen, nozzles 80 will preferably be located sufficiently above the lowermost nozzles to permit the consumption of substantially all of the oxygen previously introduced before additional oxygen is admitted. Studies have shown that the oxygen introduced into contact with the hot char particles near the lower end of the burner is consumed very rapidly, generally in from about 0.001 to about 0.2 second. The required spacing of the second set of nozzles above the lowermost nozzles can therefore be calculated. Additional oxygen-containing gas may be injected into the burner near the upper end thereof through line 81 and nozzles 82 if desired. The total quantity of oxygen introduced into the burner should normally be sufficient to permit the combustion of enough carbon to effect a temperature rise in the unburned particles of from about 50° to about 300° F., preferably about 200° F. The total amount of oxygen needed and the volume of oxygen-containing gas which will thus be required for a particular set of operating conditions can be computed. In general, it is normally preferred to inject air at the rate of from about 0.02 to about 0.2 pound per pound of char being circulated through the burner. If an oxygen-containing gas having a lower oxygen content than air is used, as will often be the case, the gas injection rate will have to be increased accordingly. The total residence time of the char solids within the burner will normally range between 0.3 and about 5.0 seconds. Residence times on this order are usually necessary because of the burner length required to handle the solids from a commercial size fluid bed reactor and because of limitations on gas velocity which are imposed by the necessity for avoiding excessive particle attrition.

The gases and hot suspended solids leaving the upper end of the transfer line burner flow into a cyclone or similar separation device 83 where the gas is separated from the larger entrained solid particles. These particles are then returned through dipleg 35 for reintroduction into the gasifier in the manner described earlier. The combustion gases are taken overhead through line 84 and passed to a second cyclone or similar separator 85 for the removal of fines. The gas is then taken overhead through line 86 and may be passed through additional centrifugal separators, scrubbers and further treating or processing equipment before being discharged as flue gas. If desired, a portion of the flue gas may be recycled through lines not shown in the drawing for use as control gas at various points in the process. The fines removed from the flue gas in separator 85 are conveyed downwardly through dipleg 87 and entrained in fines return gas introduced through line 88. The entrained particles then move through line 63 into line 33 for return to the burner. This use of the fines reduces carbon losses in the system and promotes more efficient burner operation.

The advantages of the system of the invention are illustrated by the results obtained in a coal gasification pilot plant similar to that shown in the drawing. During the operation of this plant, Wyodak coal which had been crushed and screened to a particle size less than about one-eighth inch and contained about 68 weight percent carbon and about 7.2 weight percent ash on a dry basis was fed into the fluidized bed gasifier continuously. Steam was introduced into the lower end of the gasifier and raw product gas was taken off overhead. Char particles withdrawn from the fluidized bed at a point below the feed coal injection level were passed through an injector of the type illustrated in FIGS. 2 and 3 and, after the removal of ash, introduced upwardly into a transfer line burner where a portion of the carbon was burned for the generation of heat. Char particles separated from the flue gas near the upper end of the burner were introduced by means of a dipleg into an injection device similar to that of FIGS. 2 and 3 and, after removal of the ash, transported upwardly into the fluidized bed of the gasifier. The gas velocities used for separating the lighter char particles of relatively low ash content from the heavier particles of higher ash content in the injection devices beneath the gasifier and burner were 0.10 and 0.14 foot per second, respectively. Solids samples were recovered from the gasifier at a point near the middle of the fluidized bed and from the two ash traps and analyzed to determine their carbon and ash contents. It was found that the char particles from the fluidized bed had a carbon content of 62.4 weight percent and an ash content of about 35.7 weight percent. The particles from the ash trap at the bottom of the burner, on the other hand, had a carbon content of only about 7.6 weight percent and an ash content of about 91.8 weight percent. The particles from the ash trap at the bottom of the gasifier contained about 25.6 weight percent carbon and about 73 weight percent ash. These results demonstrate that the system of the invention permits excellent separation of the ash and sharply reduces the amount of carbon which is withdrawn with the ash. This makes possible significant improvements in carbon utilization, alleviates difficulties due to the buildup and accumulation of ash deposits, and provides a highly effective method for the elimination of ash without the difficulties that have characterized methods used in the past.

What is claimed is:

1. A method for the removal of ash from a fluidized bed system for the gasification of coal or similar carbonaceous solids containing ash-forming constituents wherein a stream of char particles is continuously withdrawn from a fluidized bed reaction vessel having a substantially vertical bottom inlet line, circulated through another vessel, and returned to said reaction vessel through said bottom inlet line which comprises introducing a dense phase stream of said char particles withdrawn from said other vessel into said bottom inlet line in a substantially horizontal direction, introducing a gas stream upwardly into said bottom inlet line at a point below the point at which said dense phase stream is introduced into said inlet line, maintaining the velocity of said gas stream at a level sufficient to entrain from said dense phase stream char particles having an ash content less than about 65 weight percent but insufficient to suspend char particles contained in said dense phase stream which have an ash content greater than about 85 weight percent; passing said gas stream and char particles entrained therein upwardly through said inlet line into said fluidized bed reaction vessel; introducing upwardly into said reaction vessel independently of said bottom inlet line sufficient additional gaseous fluid to maintain the char particles contained therein in a fluidized state; and withdrawing char particles which are not entrained in said gas stream from said inlet line at a point below that at which said dense phase stream of char particles is introduced into said line.

2. A method as defined by claim 1 wherein said particles are coal char particles and said other vessel is a combustion vessel.

3. A method as defined by claim 1 wherein the velocity of said gas stream is maintained between about 0.05 and about 3.0 feet per second.

4. A method as defined by claim 1 wherein said other vessel has a substantially vertical bottom inlet line; a gas stream is passed upwardly through the bottom inlet line of said other vessel into said other vessel; char particles withdrawn from said fluidized bed are introduced into the bottom inlet line of said other vessel as a dense phase stream moving into said gas stream in a substantially horizontal direction; the velocity of said gas stream in the bottom inlet line of said other vessel is maintained at a level sufficient to entrain from said dense phase stream moving into said gas stream char particles having an ash content less than about 65 weight percent but insufficient to entrain char particles having an ash content greater than about 85 weight percent; additional gaseous fluid is introduced upwardly into said other vessel independently of the bottom inlet line of said other vessel; char particles which are not entrained upwardly into said other vessel by said gas stream in the bottom inlet line of said other vessel are collected; and the collected char particles are withdrawn from the system.

5. A method as defined by claim 4 wherein said other vessel is a transfer line burner, said gas stream passed upwardly through the bottom inlet line of said other vessel contains insufficient oxygen to initiate combustion of char particles entrained therein, and said additional gaseous fluid introduced into said other vessel independently of said bottom inlet line comprises air.

6. A method as defined by claim 4 wherein said gas stream passed upwardly into said other vessel through the bottom inlet line thereof has a velocity between about 0.1 and about 2.0 feet per second.

7. A method as defined by claim 4 wherein said gas stream passed upwardly into said other vessel through the bottom inlet line thereof comprises recycle flue gas.

8. In a process wherein carbonaceous solids including ash-forming constituents are withdrawn from a first vessel having a substantially vertical bottom inlet line, introduced into a second vessel having a substantially vertical bottom inlet line through said bottom inlet line in said second vessel, withdrawn from said second vessel, and returned to said first vessel through said bottom inlet line in said first vessel and wherein carbon contained in said solids is partially consumed in at least one of said vessels and ash tends to accumulate in the system, the improvement which comprises introducing a dense phase stream of said carbonaceous solids withdrawn from said second vessel into said bottom inlet line of said first vessel in a substantially horizontal direction, introducing a stream of carrier gas into said bottom inlet line of said first vessel at a point below that at which said dense phase stream of solids is introduced into said inlet line of said first vessel, passing said stream of carrier gas upwardly in said inlet line of said first vessel at a velocity sufficient to entrain particles from said dense phase stream having an ash content less than about 65 weight percent but insufficient to entrain particles from said dense phase stream having an ash content greater than about 85 weight percent; passing said stream of carrier gas and solid particles entrained therein from said bottom inlet line of said first vessel into said first vessel; introducing additional gaseous fluid into said first vessel near the lower end thereof independently of said bottom inlet line therein to maintain the carbonaceous solids contained within said first vessel in a fluidized state; collecting solid particles which are not entrained in said stream of carrier gas in said bottom inlet line of said first vessel; and withdrawing the collected particles from the system.

9. A process as defined by claim 8 wherein said carbonaceous solids comprise coal char particles, said first vessel is a gasifier, and said second vessel is a transfer line burner.

10. A process as defined by claim 9 wherein said velocity of said stream of carrier gas in said bottom inlet line of said first vessel is maintained between about 0.1 and about 2.0 feet per second.

* * * * *